US009234726B2

(12) United States Patent
Sharrock

(10) Patent No.: US 9,234,726 B2
(45) Date of Patent: Jan. 12, 2016

(54) FIREARM TARGET

(71) Applicant: Robert Z. Sharrock, San Jose, CA (US)

(72) Inventor: Robert Z. Sharrock, San Jose, CA (US)

( * ) Notice: Subject to any disclaimer, the term of this patent is extended or adjusted under 35 U.S.C. 154(b) by 211 days.

(21) Appl. No.: 13/929,656

(22) Filed: Jun. 27, 2013

(65) Prior Publication Data

US 2015/0001802 A1 Jan. 1, 2015

(51) Int. Cl.
*F41J 5/00* (2006.01)
*F41J 5/24* (2006.01)

(52) U.S. Cl.
CPC ..... *F41J 5/24* (2013.01)

(58) Field of Classification Search
CPC ..... F41J 1/01; F41J 5/24; F41J 5/00
USPC ..... 273/378, 380, 403–410; 8/405; 283/89, 283/111
See application file for complete search history.

(56) References Cited

U.S. PATENT DOCUMENTS

| | | | | | |
|---|---|---|---|---|---|
| 3,330,561 | A * | 7/1967 | Kandel | F41J 5/00 | 273/378 |
| 3,895,803 | A | 7/1975 | Loe | | |
| 3,899,175 | A * | 8/1975 | Loe | 273/378 | |
| 5,186,468 | A * | 2/1993 | Davies | 273/378 | |
| 5,188,371 | A | 2/1993 | Edwards | | |
| 5,275,890 | A | 1/1994 | Wolf et al. | | |
| 5,501,467 | A | 3/1996 | Kandel | | |
| 5,580,063 | A * | 12/1996 | Edwards | 273/378 | |
| 6,019,375 | A * | 2/2000 | West, Jr. | 273/378 | |
| 6,845,982 | B2 * | 1/2005 | Kirk et al. | 273/349 | |
| 7,631,877 | B2 * | 12/2009 | Zara | 273/378 | |
| 8,596,643 | B1 * | 12/2013 | Edwards | 273/378 | |
| 2006/0236470 | A1 * | 10/2006 | Sabnis | A61K 8/4973 | 8/405 |
| 2013/0270773 | A1 * | 10/2013 | Johnson | F41J 5/24 | 273/408 |

* cited by examiner

*Primary Examiner* — Mark Graham
(74) *Attorney, Agent, or Firm* — Douglas L. Weller

(57) ABSTRACT

Feedback is provided to a marksman by placing a target graphic over a sensitive layer. As a result of a bullet penetrating the sensitive layer, the appearance of regions of the sensitive layer immediately around a bullet hole gradually change appearance. The regions first appear to have a first color and then gradually change to a second color within a predetermined length of time.

13 Claims, 2 Drawing Sheets

FIREARM TARGET

BACKGROUND

Firearm targets are used to help firearm marksmen to improve their accuracy. They are typically used in a shooting range or other controlled environment.

A firearm target is often composed of a target graphic printed onto a paper substrate. The target graphic may include concentric rings with a "bull's eye" in the center.

After a shooting session, holes in a target can be inspected to check accuracy of the marksman. With good light and binoculars, it is often possible to check accuracy in the middle of a shooting session without removing a target. However, when lighting is poor, and/or the caliber of ammunition is small, it is sometimes difficult to precisely determine shooting accuracy without approaching the target to get a closer look.

To improve visibility of bullet holes when inspected from a distance, some targets include covering all or part of the target with a layer of detachable black ink. The layer with the detachable black ink is placed over a much lighter colored layer. When a bullet strikes a part of the target covered by black ink, the layer covered with dark ink fractures around the bullet hole. The portion of the layer covered with dark ink that fractures will be larger than the bullet hole. This will expose part of the lighter colored layer immediately around the bullet hole. This makes it easier for a marksman to detect, from a distance, the location of bullet holes.

DESCRIPTION OF THE EMBODIMENT

Figure 1:
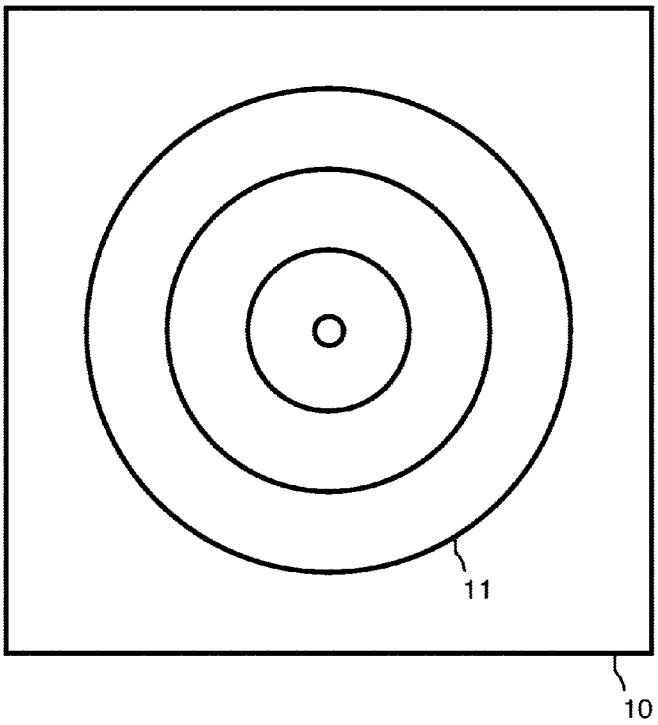
FIG. 1 shows a target graphic on a multi-layer media substrate in accordance with an embodiment.

FIG. 1 shows a target graphic 11 placed on a multi-layer media substrate 10. The target graphic 11 can have any color scheme that is helpful for user viewing. For example, target graphic 11 may appear mostly black with the concentric circles in target graphic 11 being florescent green and the bull's eye being red. Areas of multi-layer media substrate 11 not being part of target graphic 11 can also be florescent green. Other suitable color schemes can also be utilized.

While in FIG. 1 only one target graphic is shown on multi-layer media substrate 11, multiple targets graphic and/or other images can be placed on multi-layer media substrate 11. The size of multi-layer media substrate 11 also can be freely chosen based on the size and number of target graphics to be included on multi-layer media substrate 11. For example, multi-layer media substrate 11 may include a backing layer that can be peeled off. For example, multiple target graphics may share a single backing layer, allowing target graphics to be individually peeled off and used.

Figure 2:
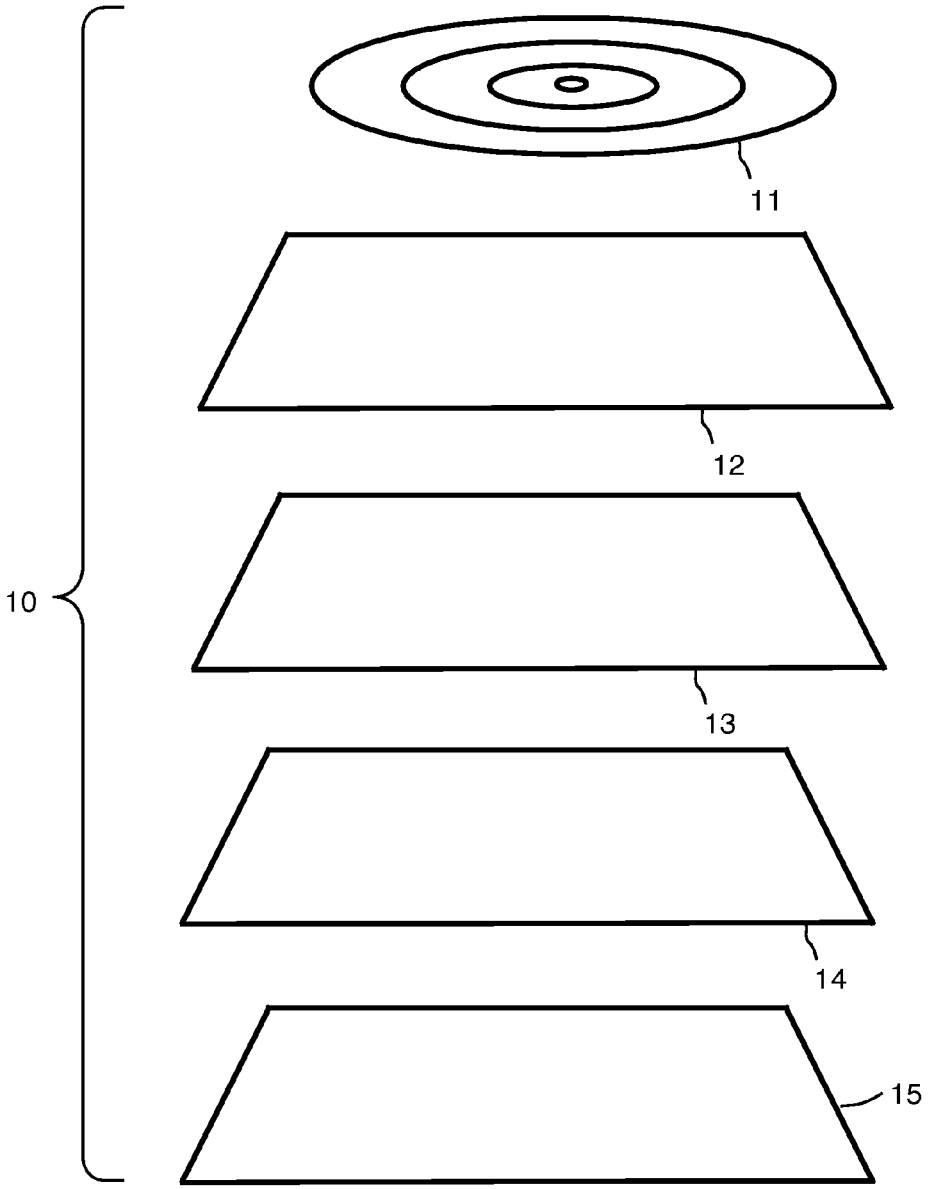
FIG. 2 shows an exploded view of the multi-layer media substrate shown in FIG. 1, in accordance with an embodiment.

FIG. 2 shows an exploded view of the multi-layer media substrate. Target graphic 11 is placed on a flake away layer 12. While in FIG. 2 target graphic 11 and flake away layer 12 are shown as separate layers, in an alternative embodiment the functionality of target graphic 11 and flake away layer 12 can be combined into a single target graphic layer that has the characteristic that it flakes away similar to the behavior of flake away layer 12.

Flake away layer 12 is placed over a blocking layer 13. For example, flake away layer 12 is opaque and prevents light from reaching blocking layer 12. Blocking layer 13 is substantially transparent to visible light but is only semi-transparent (e.g., semi-opaque) to UV light. Blocking layer 13 is placed over an environmentally sensitive layer 14. Environmentally sensitive layer 14 changes from transparent to an opaque color when illuminated by ultraviolet light. For example environmentally sensitive layer 14 is implemented using photochromic ink or photochromic paint that is sensitive to ultraviolet light and changes from transparent to an opaque color when illuminated by ultraviolet light. Environmentally sensitive layer 14 is placed over a background color sheet 15.

Blocking layer 13 is, for example, a laminate layer is substantially transparent to visible light and that partially blocks UV light a selected amount to control a rate at which environmentally sensitive layer 14 changes from transparent to an opaque color. The more UV light that blocking layer blocks, the slower environmentally sensitive layer 14 changes from transparent to an opaque color when illuminated by ultraviolet light.

The type of photochromic ink and the UV blocking capacity of blocking layer 13 is selected so that environmentally sensitive layer 14 changes from transparent to an opaque color within a predetermined length of time of being exposed to a certain intensity of ultraviolet light. The predetermined length of time is, for example, between a very few seconds (e.g., three or four seconds) and a longer period of time (e.g., a minute or more). The time is selected, based on user preference, to be long enough for a marksman to recognize the location on target graphic 11 of his or her most recent shot or shots, in comparison to the location on target graphic 11 of shots made longer ago than the predetermined length of time.

When a bullet strikes a part of target graphic 11, flake away layer 12 fractures around the bullet hole. The portion of flake away layer 12 that fractures will be larger than the bullet hole. This will expose part of blocking layer 13. Initially, at the locations where flake away layer 12 flakes off of blocking layer 13, the target will have the color of background color sheet 15. This is because before environmentally sensitive layer 14 changes from transparent to an opaque color, both blocking layer 13 and environmentally sensitive layer 14 will be substantially transparent allowing the color of the exposed regions of blocking layer 13 to appear the color of background color sheet 15. As blocking layer 13 is exposed to UV light, some of that UV light will penetrate blocking layer 13 and affect the opacity of environmentally sensitive layer 14. Eventually when environmentally sensitive layer 14 completes changes from transparent to an opaque color the color of the exposed regions of blocking layer 13 will appear to have this new opaque color of environmentally sensitive layer 14 and no longer to appear to be the color of background color sheet 15.

For example, background color sheet 15 is fluorescent green, fluorescent yellow or some other suitable color. As environmentally sensitive layer 14 is exposed to the environment environmentally sensitive layer 14 will change from transparent to an opaque shade of red or some other suitable color within the predetermined length of time. This will make it easier for a marksman to identify the location on target graphic 11 of most recent shot or shots (shots made most recently within the predetermined length of time) as well as the location on target graphic 11 of shots made a longer time ago than the predetermined length of time.

The predetermined length of time can be varied, for example, by varying the chemical combination of inks used to form environmentally sensitive layer 14 and by varying the opaqueness/transparency of blocking layer 13

Ultraviolet light blocking material (such as zinc oxide, titanium dioxide) can be mixed with photochromic paint or photochromic ink used to form environmentally sensitive layer 14. The ultraviolet light blocking material can reduce the amount of UV light available to cause the color change, and thus will tend to slow the color change, increasing the length of time it takes exposed portions of environmentally sensitive layer 14 to fully change colors.

While in the above-described embodiments, blocking layer 13 is used to control the rate at which environmentally sensitive layer 14 changes from being substantially transparent to being a substantially opaque color. Where environmentally sensitive layer 14 changes from being substantially transparent to being a substantially opaque color at a satisfactory rate without the existence of a blocking layer, blocking layer 13 can be omitted.

Likewise, while in the above-described embodiments, environmentally sensitive layer 14 changes from being substantially transparent to being a substantially opaque color other embodiments can be utilized. For example, environmentally sensitive layer 14 can change from being a substantially opaque first color to being a substantially opaque second color. In this case it does not matter what color background layer 15 is. Background layer 15 can also be omitted in such embodiments provided there environmentally sensitive layer 14 provides sufficient rigidity and support for the target.

While in the above-described embodiments, environmentally sensitive layer 14 is sensitive to ultraviolet light, other embodiments of environmentally sensitive layer 14 can be effective. For example, environmentally sensitive layer 14 can be sensitive to a spectrum of visible light in addition to, or instead of, ultraviolet light.

In another environment, environmentally sensitive layer 14 is an oxygen sensitive layer. In this case, blocking layer 13, if used, may be, for example, semi-permeable material that slows a rate at which oxygen reaches environmentally sensitive layer 14. In this embodiment, flake away layer 12 is impermeable to oxygen.

When a bullet strikes a part of target graphic 11, flake away layer 12 fractures around the bullet hole. The portion of flake away layer 12 that fractures will be larger than the bullet hole. This will expose part of blocking layer 13 (if present) over environmentally sensitive layer 14. Environmentally sensitive layer 14 will first be transparent so that the background color of background layer 15 will be visible. As environmentally sensitive layer 14 is exposed to oxygen, environmentally sensitive layer 14 will, within the predetermined length of time, change from being transparent to being an opaque color, or will change from a first opaque color to a second opaque color. This will make it easier for a marksman to identify the location on target graphic 11 of the most recent shot or shots (i.e., shots made within the predetermined length of time) as well as the location on target graphic 11 of shots made a longer time ago than the predetermined length of time.

Instead of being an oxygen sensitive layer, environmentally sensitive layer 14 can be formed to be sensitive to other things in its immediate (atmospheric) environment, such as, nitrogen, water vapor, carbon dioxide and so on.

Instead of being sensitive to something in the ambient environment, environmentally sensitive layer 14 can also be sensitive to something in its immediate environment that is delivered by a bullet. For example, environmentally sensitive layer 14 is sensitive to gunpowder residue. As environmentally sensitive layer 14 is exposed to gunpowder residue left by a bullet, environmentally sensitive layer 14 will, within the predetermined length of time, change from being transparent to being an opaque color, or will change from a first opaque color to a second opaque color. A marksman will be able to identify the most recent bullet location within target graphic 11 as the marksman watches gunpowder residue at that location affect the color of environmentally sensitive layer 14.

Instead of gunpowder, the bullet can be coated with a chemical that will trigger a color change within environmentally sensitive layer 14. As environmentally sensitive layer 14 is exposed to a residue of the chemical left by a bullet, environmentally sensitive layer 14 will, within the predetermined length of time, change from being transparent to being an opaque color, or will change from a first opaque color to a second opaque color.

In another embodiment, changes in opacity or in color of environmentally sensitive layer 14 can be triggered by heat, the friction of the bullet or some other aspect related to motion of the bullet The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A firearm target comprising:

a flake away layer; and, an environmentally sensitive layer covered by the flake away layer, the environmentally sensitive layer changing color at regions where the flake away layer is removed from the environmentally sensitive layer, wherein the change in color takes three or more seconds to complete;

wherein when a bullet penetrates the flake away layer and the environmentally sensitive layer, portions of the flake away layer flake off immediately surrounding a resulting bullet hole through the environmentally sensitive layer.

2. A firearm target as in claim 1 additionally comprising:

a target graphic visible to a user.

3. A firearm target as in claim 1, wherein the environmentally sensitive layer is sensitive to visible light and the flake away layer blocks out visible light.

4. A firearm target as in claim 1, wherein the environmentally sensitive layer is sensitive to oxygen and the flake away layer blocks out oxygen.

5. A firearm target as in claim 1, wherein the environmentally sensitive layer is sensitive to gunpowder residue.

6. A firearm target as in claim 1, wherein the environmentally sensitive layer is sensitive to ultraviolet light and the flake away layer blocks out ultraviolet light.

7. A firearm target as in claim 6 additionally comprising:

a blocking layer placed between the flake away layer and the environmentally sensitive layer, the blocking layer being substantially transparent to visible light and semi-transparent to ultraviolet light, the blocking layer working to slow a rate at which environmentally sensitive layer changes color at regions where the flake away layer is removed.

8. A firearm target as in claim 1 wherein the environmentally sensitive layer changes color by changing from being substantially transparent to being an opaque color.

9. A firearm target comprising:

a target graphic visible to a user;

a sensitive layer, wherein when a bullet penetrates the sensitive layer, regions of the sensitive layer immediately around the bullet hole appear to have a first color and then gradually change to appear to have a second color, the gradual change in color taking three or more seconds;

a flake away layer placed over the sensitive layer so that the bullet penetrates the flake away layer before penetrating the sensitive layer, resulting in portions of the flake away layer flaking off and exposing the regions of the sensitive layer immediately around the bullet hole; and, a background layer located beneath the sensitive layer, the background layer having the first color, wherein the sensitive layer is sensitive to ultraviolet light, so that when the bullet penetrates the flake away layer and the sensitive layer resulting in portions of the flake away layer flaking off to expose the regions of the sensitive layer immediately around the bullet hole, the sensitive layer is first transparent resulting in the regions of the sensitive layer immediately around the bullet hole to appear to have the first color, exposure to ultraviolet light resulting in the sensitive layer gradually changing from being transparent to the second color.

10. A firearm target as in claim 9, additionally comprising:

a blocking layer located over the sensitive layer and beneath the flake away layer, the blocking layer being substantially transparent to visible light and only semi-transparent to ultraviolet light so that when the bullet penetrates the flake away layer, the blocking layer and the sensitive layer resulting in portions of the flake away layer flaking off to expose the regions of the sensitive layer, as covered by the blocking layer, immediately around the bullet hole, the blocking layer reduces an amount of ultraviolet light that reaches the regions of the sensitive layer immediately around the bullet hole slowing a rate at which the sensitive layer gradually changes from being transparent to the second color.

11. A method for providing feedback to a marksman, the method comprising:

placing a target graphic over a sensitive layer; and, gradually changing appearance of regions of the sensitive layer immediately around a bullet hole as a result of a bullet penetrating the sensitive layer, the regions first appearing to have a first color and then gradually changing within a predetermined length of time so as to appear to have a second color, wherein the predetermined length of time is three or more seconds, wherein the first color is changed to the second color as a result of the sensitive layer being sensitive to ultraviolet light.

12. A method as in claim 11 additionally comprising:

placing a flake away layer over the sensitive layer so that the bullet penetrates the flake away layer before penetrating the sensitive layer, resulting in portions of the flake away layer flaking off and exposing the regions of the sensitive layer immediately around the bullet hole.

13. A method as in claim 12 additionally comprising:

placing a blocking layer over the sensitive layer and beneath the flake away layer, the blocking layer being substantially transparent to visible light and only semi-transparent to ultraviolet light so that when the bullet penetrates the flake away layer, the blocking layer and the sensitive layer resulting in portions of the flake away layer flaking off to expose the regions of the sensitive layer, as covered by the blocking layer, immediately around the bullet hole, the blocking layer reduces an amount of ultraviolet light that reaches the regions of the sensitive layer immediately around the bullet hole slowing a rate at which the sensitive layer gradually changes from being transparent to the second color.

* * * * *